United States Patent [19]

Stolzman

[11] Patent Number: 4,741,453

[45] Date of Patent: May 3, 1988

[54] CONTAINER AND CLOSURE WITH FASTENING MEANS

[75] Inventor: Michael D. Stolzman, Lake Forest, Ill.

[73] Assignee: International Precision Components Corporation, Lake Forest, Ill.

[21] Appl. No.: 64,673

[22] Filed: Jun. 22, 1987

[51] Int. Cl.[4] ..... B65D 45/00

[52] U.S. Cl. ..... 220/315; 220/319; 220/320; 229/5.7

[58] Field of Search ..... 220/315, 319, 320; 229/5.7

[56] References Cited

U.S. PATENT DOCUMENTS

| | | | |
|---|---|---|---|
| 3,223,278 | 12/1965 | Allen | 220/320 |
| 4,158,423 | 6/1979 | Starr | 220/320 |
| 4,305,535 | 12/1981 | Brundige et al. | 229/5.7 |
| 4,377,245 | 3/1983 | Patty | 220/319 |

*Primary Examiner*—George T. Hall

*Attorney, Agent, or Firm*—Wood, Dalton, Phillips, Mason & Rowe

[57] ABSTRACT

A container having a tubular sidewall. A closure is mounted to one end of the sidewall by molding in situ. The sidewall end portion is provided with an array of circumferentially spaced through openings, and the closure includes a U-shaped connecting portion having a pair of spaced legs on opposite sides of the end portion, with securing portions extending between the legs through the openings. The closure is injection molded so as to clamp the end portion of the tubular element between the legs and sealingly connect the closure thereto. At the opposite end, a connecting ring is formed in situ on the end portion of the tubular element in the same manner as the connecting portion of the first described closure. The connecting ring includes a radially outwardly opening annular recess adapted to receive an inturned complementary flange on a removable closure member. The flange is split and the removable closure member is provided with a pair of tabs. A bolt is provided for adjustably drawing the tabs together to constrict the split flange into the connecting member recess for removably securing the second closure to the connecting member.

31 Claims, 1 Drawing Sheet

FIG. 1
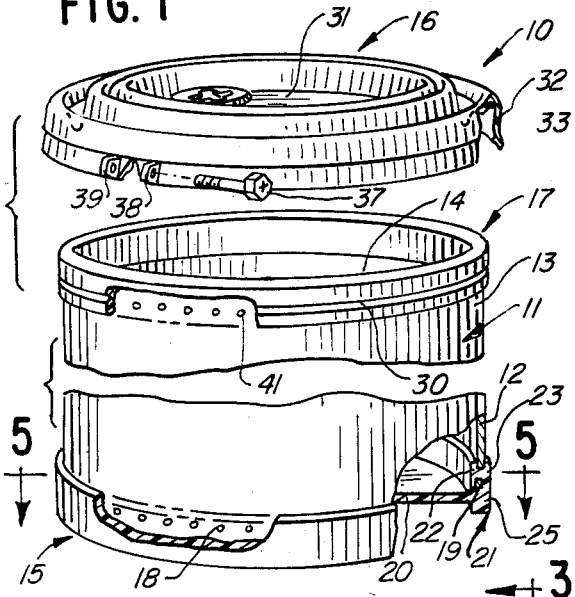
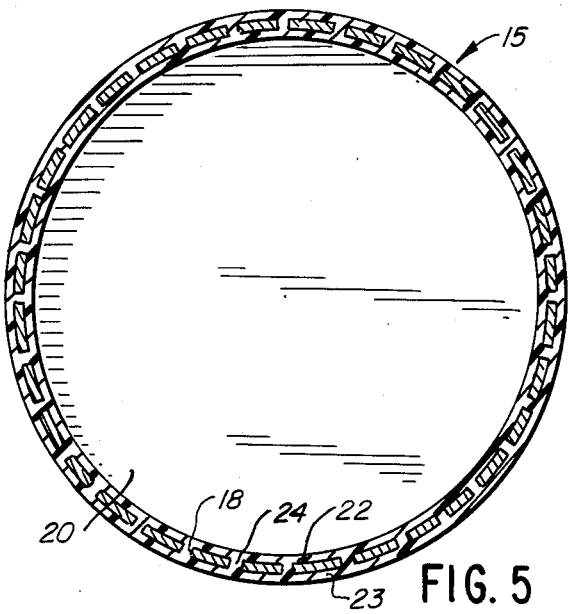
FIG. 5
FIG. 2
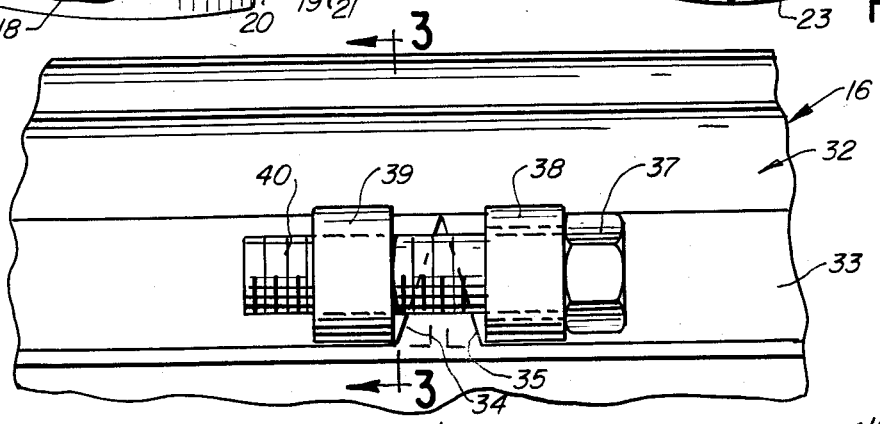
FIG. 3
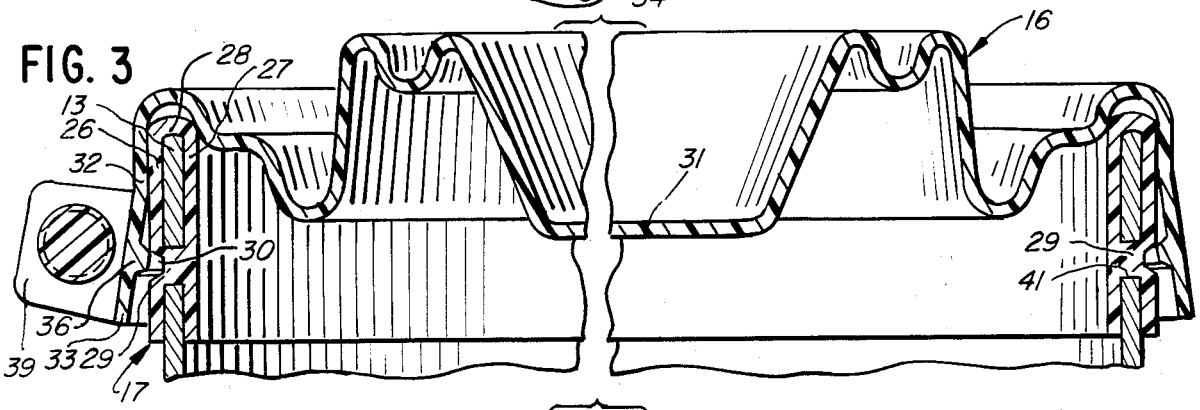
FIG. 4
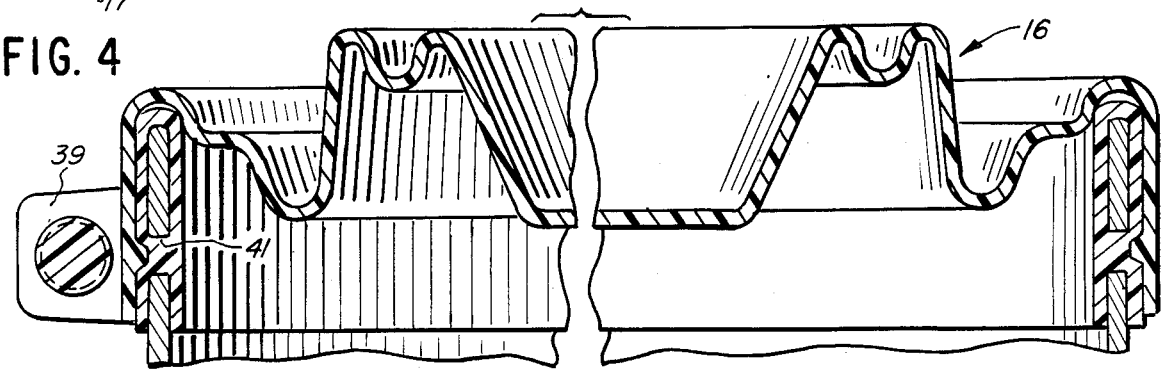

CONTAINER AND CLOSURE WITH FASTENING MEANS

TECHNICAL FIELD

This invention relates to containers and in particular to containers having a tubular sidewall.

BACKGROUND ART

In one form of conventional shipping and storage container, a tubular sidewall is formed of fibrous material. It is conventional to provide metal securing rings at opposite ends of the sidewall for securing closure walls thereacross. Such metal securing rings are relatively costly and heavy and are not fully satisfactory in the formation of a low cost shipping and storage container.

DISCLOSURE OF INVENTION

The present invention comprehends an improved container having a tubular sidewall defining opposite open ends.

The invention comprehends closing one end of the container by means of a closure molded of synthetic resin in situ in association with the end portion of the sidewall thereat, the closure having a transverse center wall portion extending across the open end of the tubular sidewall, and a U-shaped annular peripheral connecting portion extending adjacent the end portion of the sidewall and defining spaced annular legs embracing the end portion. The connecting portion further includes a plurality of securing portions extending between the legs and through a plurality of circumferentially spaced openings in the sidewall end portion.

The invention further comprehends the provision of an improved removable cover for closing one end of the tubular sidewall. The removable closure means includes a connecting ring molded of synthetic resin in situ in association with the end portion of the sidewall and comprising a U-shaped annular element defining spaced annular legs embracing the sidewall end portion and having a plurality of securing portions extending between the legs through circumferentially spaced openings provided in the sidewall end portion. The connecting ring includes a radially outwardly opening annular recess and a closure is removably mounted to the connecting ring by a portion thereof removably interlocked with the connecting ring in the recess.

In the illustrated embodiment, the closure is formed of a molded synthetic resin and includes a transverse center wall. The portion of the closure interlocked with the connecting ring comprises a radially inwardly projecting split peripheral flange removably received in the annular recess of the connecting ring for retaining the closure to the connecting ring across the open end of the space.

The closure, in the illustrated embodiment, includes a pair of radially outturned tabs at the opposite ends of the split annular flange and means are provided for adjustably drawing the tabs towards each other to constrict the flange into the annular recess of the connecting ring.

The invention comprehends the forming of the closures and connecting ring as by injection molding of suitable synthetic resin, such as high density polyethylene. The forming of the closure at one end of the tubular element and the connecting ring at the opposite end thereof by molding in situ these elements in retained association with the opposite ends of the tubular element provides a low cost, substantially improved container structure.

The container structure of the present invention is extremely simple and economical, while yet providing the highly desirable features discussed above.

BRIEF DESCRIPTION OF THE DRAWING

Other features and advantages of the invention will be apparent from the following description taken in connection with the accompanying drawing wherein:

FIG. 1 is a fragmentary exploded view of a container embodying the invention;

FIG. 2 is a fragmentary enlarged elevation of a portion of the removable closure;

FIG. 3 is a fragmentary transverse section taken substantially along the line 3—3 of FIG. 2;

FIG. 4 is a fragmentary section similar to that of FIG. 3, but with the removable closure secured to the connecting ring; and FIG. 5 is a transverse section taken substantially along the line 5—5 of FIG. 1.

BEST MODE FOR CARRYING OUT THE INVENTION

In the illustrative embodiment of the invention as disclosed in the drawing, a container generally designated 10 is shown to include a fibrous tubular sidewall 11. In the illustrated embodiment, the sidewall defines a right cylinder, it being understood that the sidewall may define other suitable configurations, such as square, oval, etc.

The sidewall defines a lower end portion 12 and an upper end portion 13. The tubular sidewall defines an internal storage space 14. The lower end of the storage space 14 is closed by a closure generally designated 15 fixedly secured to the sidewall end portion 12, as seen in FIG. 1. The open upper end of the space 14 is selectively closed by a second closure generally designated 16 removably secured to a connecting ring generally designated 17 fixedly secured to the upper end portion 13 of the sidewall.

As seen in FIGS. 1 and 5, sidewall end portion 12 is provided with an array of through openings 18 adjacent the distal end 19 thereof. Openings 18 are equidistantly circumferentially spaced about the sidewall end portion 12.

Closure 15 comprises a unitary element molded of a suitable synthetic resin, such as high density polyethylene. The closure is molded in situ in association with the sidewall end portion 12 and defines a transverse center wall portion 20 closing the lower end of the container space 14.

Closure 15 further defines a peripheral connecting portion generally designated 21 extending adjacent the sidewall end portion 12. As seen in FIG. 1, the connecting portion comprises a U-shaped annular peripheral portion of the closure defining spaced annular legs 22 and 23 embracing the distal end of the sidewall end portion 12 and having a plurality of securing portions 24 extending between legs 22 and 23 through the openings 18 for securing the closure 15 to the sidewall end portion 12.

As shown in FIG. 1, the openings 18 are circular and are spaced a preselected distance outwardly from the distal end 19 of the sidewall end portion. As further shown in FIG. 1, the closure 15 may include a downturned annular peripheral flange 25 extending oppositely to the legs 22 and 23, such as for use in stacking the closed containers.

Legs 22 and 23 may comprise relatively thin wall flanges, illustratively having a thickness of approximately 0.100". The center wall portion 20 may have a thickness greater than that of the legs, as desired.

The closure 15 may be formed in situ on the sidewall end portion 12 as by injection molding thereof. Such formation of the closure provides improved connection of the closure to the sidewall by affording a sealed facial engagement with the sidewall end portion. The pressure applied to the fluid synthetic resin effects a compression of the sidewall end portion, thereby providing a positive sealed connection of the closure to the end portion, with the closure securing portions 24 maintaining the closure against longitudinal displacement from the sidewall end portion 12 and, in cooperation with the clamped embracing of the sidewall end portion by the closure legs, provides a positive sealed connection of the closure to the sidewall at end portion 12.

As discussed above, closure 16, at the opposite end of the tubular sidewall, is secured to the end portion 13 through the connecting ring 17. The connecting ring is molded of synthetic resin in situ in association with the end portion 13 and is generally similar to connecting portion 21 of closure 15.

More specifically, sidewall end portion 13 is provided with an array of through openings 41 similar to openings 18 in end portion 12. The connecting ring defines a pair of legs 26 and 27 joined by the bight 28 so as to embrace sidewall end portion 13, as illustrated in FIG. 3.

Connecting ring 17 further includes a plurality of securing portions 29 extending through the openings 41. The connecting ring is preferably molded in situ to the tubular sidewall end portion 13 as by injection molding so as to secure the connecting ring to the sidewall end portion 13 in sealed, clamped association similar to the association between connecting portion 21 of closure 15 and the opposite sidewall end portion 12.

Connecting ring 17 further defines a peripheral, radially outwardly opening annular recess 30 having an outwardly widening trapezoidal cross section. Closure 16 includes a central portion 31 and a peripheral depending thin wall 32. The lower distal portion 33 of wall 32 comprises a split annular portion having opposed ends 34 and 35, as shown in FIG. 2. Wall portion 33, as shown in FIG. 3, is further provided with a radially inwardly projecting flange 36, which is correspondingly split.

Flange 36 has a radially inwardly narrowing frustoconical cross section complementary to the cross section of recess 30 and is adapted to be removably received in the recess as a result of constriction of the split annular wall portion 33.

Constriction of the wall portion 33 is effected by threaded adjustment of a bolt 37 through a pair of radially outwardly projecting tabs 38 and 39 on split wall portion 33 adjacent the spaced ends 34 and 35 thereof. As shown in FIG. 2, the shank 40 of bolt 37 extends freely through tab 38 and is threaded into tab 39 to provide the desired adjustable drawing together of the tabs 38 and 39 in securing the closure 16 to the connecting ring 17.

The container structure of the present invention provides low cost provision of the end wall closure at one end of the tubular element and removable mounting of the closure to the opposite end of the tubular sidewall element, with positive sealed connection of the closures to the sidewall ends without the need for the costly and heavy metal closure connecting means of the prior art. Further, the metal connecting means of the prior art has required the forming of the ends of the tubular sidewall to conform with the unique configuration of the metal securing means. The present invention eliminates the need for such forming and utilizes, in lieu thereof, the array of threadedly formed through openings 18 and 41.

The foregoing disclosure of specific embodiments is illustrative of the broad inventive concepts comprehended by the invention.

I claim:

1. A container comprising: a tubular sidewall defining a peripherally enclosed space, said sidewall having an annular end portion defining an open end of said space, said end portion being provided with through openings spaced circumferentially about said open end; and a closure molded of synthetic resin in situ in association with said end portion of the sidewall, said closure having a transverse center wall portion closing said end of said space, and a U-shaped, annular peripheral connecting portion extending adjacent said end portion of the sidewall and defining spaced annular legs embracing said end portion, said connecting portion further having a plurality of securing portions extending between said legs through said openings in said sidewall end portion.

2. The container of claim 1 wherein said connecting portion comprises a pair of concentric, radially spaced upstanding flanges on the periphery of said center wall portion.

3. The container of claim 1 wherein said openings in said sidewall end portion are spaced equidistantly from the distal ends of said sidewall end portion.

4. The container of claim 1 wherein said openings in said sidewall end portion are spaced equidistantly circumferentially about said sidewall end portion.

5. The container of claim 1 wherein said openings in said sidewall end portion comprise circular openings.

6. The container of claim 1 wherein said closure further defines a downturned peripheral annular flange extending oppositely away from said connecting portion.

7. The container of claim 1 wherein said connecting portion comprises a pair of concentric, radially spaced upstanding flanges on the periphery of said center wall portion, the radial thickness of said flanges being less than the thickness of said center wall portion.

8. The container of claim 1 wherein said connecting portion is disposed in facial sealing engagement with said sidewall end portion.

9. The container of claim 1 wherein said connecting portion comprises a pair of concentric, radially spaced upstanding flanges on the periphery of said center wall portion disposed in facial sealing engagement with said sidewall end portion.

10. The container of claim 1 wherein said connecting portion comprises a pair of concentric, radially spaced upstanding flanges on the periphery of said center wall portion, said sidewall end portion being compressively clamped between said flanges.

11. The container of claim 1 wherein said connecting portion comprises a pair of concentric, radially spaced upstanding flanges on the periphery of said center wall portion, said sidewall end portion being compressively clamped between said flanges with a preselected clamping force.

12. A container comprising:

a tubular sidewall defining a peripherally enclosed space, said sidewall having an annular end portion defining an open end of said space, said end portion being provided with an array of through openings spaced circumferentially about said open end;

means for closing the opposite ends of said space;

a connecting ring molded of synthetic resin in situ in association with said end portion of the sidewall, said connecting ring comprising a U-shaped, annular element defining spaced annular legs embracing said end portion, and having a plurality of securing portions extending between said legs through said openings in said sidewall end portion, said connecting ring further having a radially outwardly opening annular recess; and a closure removably mounted to said connecting ring, including a portion removably interlocked with said connecting ring in said recess.

13. The container of claim 12 wherein said annular recess is aligned with said array of securing portions.

14. The container of claim 12 wherein said annular recess defines a radially outwardly widening trapezoidal cross section.

15. A container comprising:

a tubular sidewall defining a peripherally enclosed space, said sidewall having an annular end portion defining an open end of said space, said end portion being provided with an array of through openings spaced circumferentially about said open end;

means for closing the opposite ends of said space;

a connecting ring molded of synthetic resin in situ in association with said end portion of the sidewall, said connecting ring comprising a U-shaped, annular element defining spaced annular legs embracing said end portion, and having a plurality of securing portions extending between said legs through said openings in said sidewall end portion, said connecting ring further having a radially outwardly opening annular recess; and, a closure removably mounted to said connecting ring, including a portion removably interlocked with said connecting ring in said recess, said closure being formed of molded synthetic resin and having a transverse center wall, said closure portion comprising a radially inwardly projecting slit peripheral flange removably received in said annular recess of said connecting ring for retaining said closure to said connecting ring across said open end of said space.

16. The container of claim 15 wherein said split flange defines spaced end portions and said closure includes a pair of radially outturned tabs adjacent said flange end portions, and means for adjustably drawing said tabs toward each other to secure said flange in said annular recess.

17. The container of claim 15 wherein said split flange defines spaced end portions and said closure includes a pair of radially outturned tabs adjacent said flange end portions, and threaded means for adjustably drawing said tabs toward each other to secure said flange in said annular recess.

18. The container of claim 15 wherein said split flange defines spaced end portions and said closure includes a pair of radially outturned tabs formed unitarily integral with said closure adjacent said flange end portions, and means for adjustably drawing said tabs toward each other to secure said flange in said annular recess.

19. The container of claim 15 wherein said flange defines a trapezoidal cross section complementary to said trapezoidal cross section of said annular recess.

20. A closure for use with a container having an annular end portion defining a radially outwardly opening annular recess, said closure comprising a unitary wall element formed of molded synthetic resin and having a transverse center wall, and a peripheral portion comprising a split annular flange having radially inwardly projecting securing structure; and means for constricting the flange to urge the securing structure radially inwardly, said securing structure being adapted to be fitted into an annular recess of a container end portion as a result of such constriction of the flange.

21. The closure of claim 20 wherein said split flange defines spaced end portions and said closure includes a pair of radially outturned tabs adjacent said flange end portions, and means for adjustably drawing said tabs toward each other to secure said securing structure in said annular recess.

22. The closure of claim 20 wherein said split flange defines spaced end portions and said closure includes a pair of radially outturned tabs adjacent said flange end portions, and threaded means for adjustably drawing said tabs toward each other to secure said securing structure in said annular recess.

23. The closure of claim 20 wherein said split flange defines spaced end portions and said closure includes a pair of radially outturned tabs formed unitarily integral with said closure adjacent said flange end portions, and means for adjustably drawing said tabs toward each other to secure said securing structure in said annular recess.

24. The closure of claim 20 wherein said securing structure comprises a split radially outturned flange.

25. The closure of claim 20 wherein said securing structure comprises a split radially outturned flange having a trapezoidal cross section.

26. The closure of claim 20 wherein said center wall includes an annular boss radially inwardly adjacent said peripheral portion of the wall element.

27. The closure of claim 20 wherein said peripheral portion includes a downwardly widening notch defining the split portion thereof.

28. The closure of claim 20 wherein said peripheral portion includes a downwardly widening triangular notch defining the split portion thereof.

29. The closure of claim 20 wherein said peripheral portion flange includes a continuously annular upper portion and a discontinuous, split lower portion.

30. The closure of claim 20 wherein said peripheral portion includes a downwardly widening notch defining the split portion thereof, and said constricting means includes tabs formed unitarily integrally with said flange at opposite sides of said notch.

31. The closure of claim 20 wherein said peripheral portion flange includes a continuously annular upper portion and a discontinuous, split lower portion angled downwardly radially outwardly from said upper portion.

* * * * *